US005186845A

United States Patent [19]

Detalle

[11] Patent Number: 5,186,845

[45] Date of Patent: Feb. 16, 1993

[54] RECTILINEARLY MOVING, AXIALLY SYMMETRICAL SLIDING GATE

[76] Inventor: Edouard Detalle, 30, avenue du General-Leclerc, F-54320 Maxeville, France

[21] Appl. No.: 465,093

[22] PCT Filed: Apr. 10, 1989

[86] PCT No.: PCT/FR89/00163

§ 371 Date: Mar. 13, 1990

§ 102(e) Date: Mar. 13, 1990

[87] PCT Pub. No.: WO89/10812

PCT Pub. Date: Nov. 16, 1989

[30] Foreign Application Priority Data

May 13, 1988 [FR] France ..... 88/06617

[51] Int. Cl.[5] ..... B22D 41/26

[52] U.S. Cl. ..... 222/598; 222/600

[58] Field of Search ..... 222/598, 599, 600, 591, 222/597

[56] References Cited

U.S. PATENT DOCUMENTS

| | | | |
|---|---|---|---|
| 3,764,042 | 10/1973 | Shapland et al. | 222/561 |
| 4,586,699 | 5/1986 | Bachmann et al. | 222/600 |
| 4,732,304 | 3/1988 | Yoshihara | 222/598 |
| 4,747,580 | 5/1988 | Tinnes et al. | 222/598 |

FOREIGN PATENT DOCUMENTS

| | | | |
|---|---|---|---|
| 2420388 | 3/1979 | France . | |
| 0037533 | 6/1959 | Luxembourg . | |
| 0374454 | 2/1964 | Switzerland . | |
| 2008729 | 6/1979 | United Kingdom . | |
| 2023784 | 1/1980 | United Kingdom | 222/599 |

OTHER PUBLICATIONS

Iron and Steel Engineer, "*Nippon Kokan's rotary nozzle system for teeming and continuous casting*" pp. 117–124 Nov. 1973.

*Primary Examiner*—Scott Kastler
*Attorney, Agent, or Firm*—Weiser & Stapler

[57] ABSTRACT

The invention relates to a device for pouring molten metals, such as steel.

a nozzle (2), known as the inner nozzle, of refractory material;

a round fixed plate (3) provided with an axial hole coinciding with the hole in the nozzle (2), and made of refractory material;

a round movable plate (4) provided with a central hole having an axis (23), and made of refractory material;

a nozzle (5), known as the collector nozzle, fastened to the movable plate (4), of refractory material and intended to stabilize the deflected stream.

The movable plate (4) can undergo displacement (17) along a straight or any other line, in such a manner as to close the hole in the fixed plate (3) to a greater or lesser extent.

The movable plate (4) is also pivotable about its axis (23).

The symmetrical shape of the various refractory members relative to their apertures, through which the metal passes at high temperature, imparts to the whole arrangement optimum characteristics of expansion and resistance to thermal shocks.

Finally, the pivotability of the plate (4), and also optionally of the plate (3), about their respective axes makes it possible to distribute the wear on the holes symmetrically and to reduce the amplitude of the displacements (17).

27 Claims, 7 Drawing Sheets

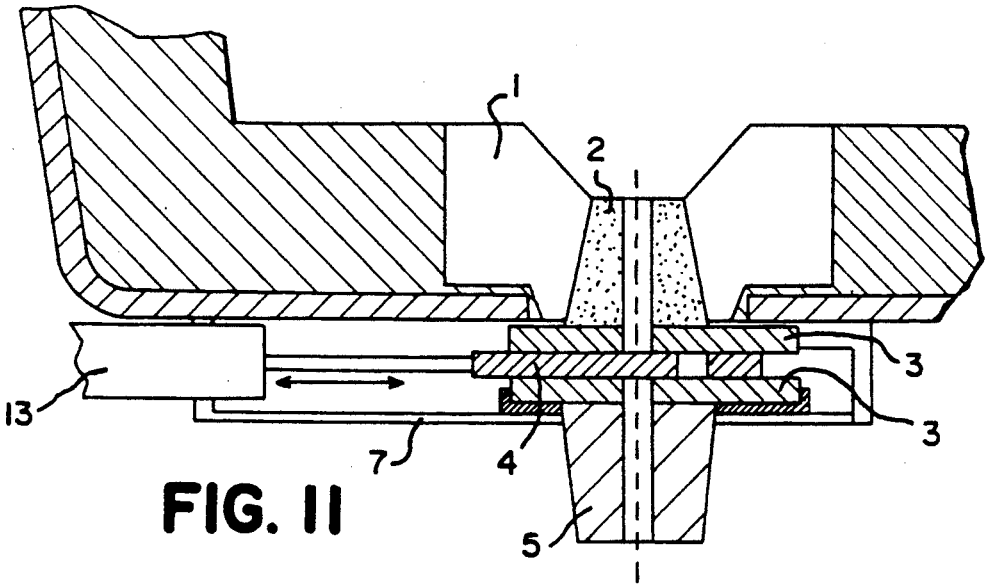
FIG. 11
FIG. 12
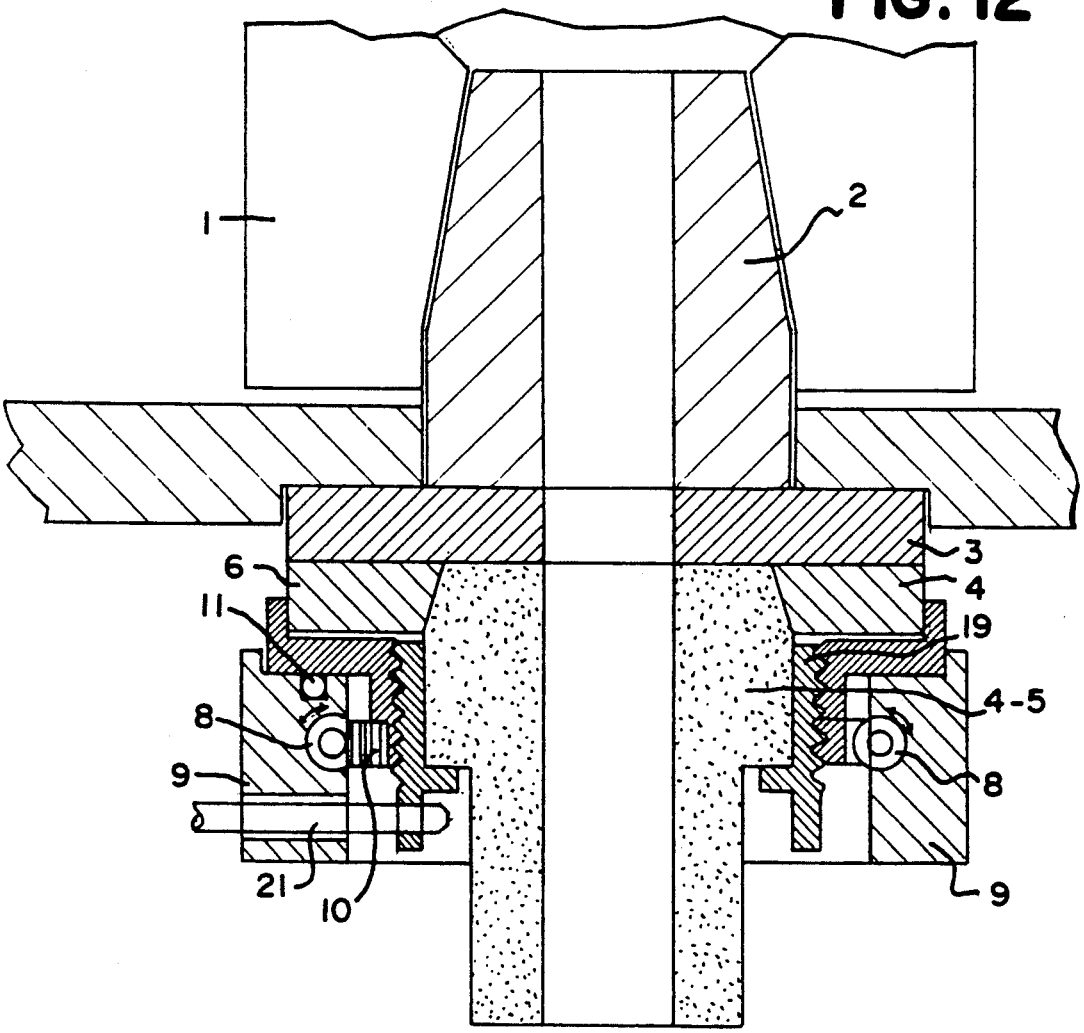

RECTILINEARLY MOVING, AXIALLY SYMMETRICAL SLIDING GATE

The present invention relates to the pouring of liquids which are corrosive or at high temperature, particularly molten metals, such as steel.

One of the most widely used devices enabling molten liquids, such as steel, to be emptied from containers is of the so-called slide valve type.

This essentially entails sliding over one another two plates of appropriate metal, which is refractory in the case of molten metals.

One of these plates is fixed and the other movable; each of them is provided with an aperture of appropriate diameter.

The coincidence of these apertures to a greater or lesser extent enables the flow to be regulated.

Non-coincidence of the apertures stops the emptying operation.

The relative displacement of the plates may be linear or rotary:

in the first case the aperture or apertures in the movable plate moves or move on a straight line;

in the second case the aperture or apertures in the movable plate moves or move in a circle.

In the case of the pouring of steel, the irruption of the metal gives rise to a violent thermal shock in the refractory plates, thus causing cracks which are detrimental in various respects' particularly:

since they make the re-use of the plates for further emptying more or less problematical;

since they may cause untimely intake of gas, particularly ambient air, through the flow of rapidly moving metal.

In order to withstand the various stresses, ferrostatic pressure, temperature of the metal, sliding characteristics, and so on, the plates must in fact be made of appropriate materials, having a high content of alumina, magnesia, zirconium' and the like, which are particularly sensitive to thermal shocks.

Moreover, the very operating principle of sliding closure means known at the present time concentrates wear on the plates in one or two zones situated on the path of the relative displacement of the plates.

This results in the ovalization of the holes in the plates, which is extended by "tongue"-shaped erosion, which finally entails the premature rejection of the plates.

These remarks are equally applicable to devices of the three-plate type, in which the movable plate slides between two fixed plates.

The present invention seeks to avoid to the greatest possible extent such cracks and such premature wear on the plates.

The studies which we have carried out have shown us that, although the nature of the materials used for the refractory plates makes them particularly sensitive to thermal shocks, the appearance of the cracks is essentially due to the asymmetrical shape of the plates.

The starting point for the thermal shock is in fact situated in the pouring apertures, where a jet of molten metal passes at high temperature, particularly in the case of steel.

The heat then diffuses towards the periphery of the plate.

In all cases known at the present time, in order to reach the periphery of the plate, where a substantially lower temperature prevails, the heat wave must travel over paths of very different lengths, so that considerable breaking tensions are produced.

This will easily be understood on examination of the configuration of the linear or rotary slide valve plates, provided with one or more apertures, which are used at the present time.

It therefore appears that the ideal solution is to develop a linear closure means having round plates and a single central aperture.

In the remainder of the description given below both the term "plate" and the term "closure member" will be used, depending on whether the height is small, similar or large in relation to the outside diameter.

In this closure means the path to be travelled by the heat wave between the pouring aperture and the periphery is the same in all directions.

The thickness of the plate or closure member is also of importance, since the first face is in contact with the other plate or member and the second face is directed either towards the container or towards the environment.

However, the tendency to break or crack is more or less great depending on the nature of the refractory material, whose physical properties, such as thermal expansion, thermal conductivity, and so on, vary substantially.

This means that a range of tolerance exists between the paths travelled by the heat wave between its starting point (periphery of the pouring aperture) and its finish point (periphery of the plate).

This therefore justifies the adoption, additionally to the ideal round shape, of symmetrical polygonal shapes respecting this tolerance between the longest path and the shortest path to be travelled between the edge of the hole and the edge of the plate.

The greater the number of sides of the polygon, the closer the approach to a perfect circle; on the other hand, the square is a particularly unfavourable case in which the distorsions between different paths of the heat wave are increased.

Apart from the classic geometrical shapes, it is possible to imagine any oval or other shapes, but the rules given above still apply, more or less strictly in dependence on the nature of the refractory or other material used.

The invention therefore retains the most perfect possible symmetry of all members subjected to thermal shocks and corrosion caused by the flow of the fluid, particularly molten steel.

It relates to a closure means of the linear displacement type.

It makes use of at least two or three members or plates of round (or polygonal close to round) shapes, in which axial holes are formed.

The principal movable plate moves along a straight line or any curve passing through its axis, the latter being common to the plate and to the hole. In order to simplify the remainder of the description, the simplest case of rectilinear movement will be considered.

It has already been mentioned above that the very principle of the linear displacement closure means leads to wear on the apertures which is located in the regions close to the axis of translation.

In order to obviate this shortcoming, and because round plates have no preferential axis in the plane, provision is made to move the wearing zone over the entire periphery of the hole through adequate rotation of the plates about their axis.

If this rotation is eade whenever necessary, it will be possible to avoid the ovalization of the hole, which is so detrimental to the life of the plates, and thus to obtain a progressive, circular enlargement of the diameter.

The rotation of the plates may be controlled by any mechanical, hydraulic or electrical process known to those versed in the art.

The travel necessary for effecting the regulation or interruption of the flow of fluid will at the same time be reduced, because wear will be distributed over the entire periphery of the hole, and not at one or two points.

In the case of a three-plate slide valve, this may apply not only to the central working plate, but also to the normally fixed top and bottom plates.

In a variant of the invention the same source of movement is used for the displacement of the movable plate and its pivoting.

It is possible to conceive a device controlled by a microprocessor, which would effect the automatic rotation of the plates whenever necessary, in dependence on parameters previously stored in its memory, such as for example the type of metal to be poured, quantity, and so on, or parameters measured in real time, such as temperature, stroke of the ram, and so on.

In a variant of the invention the plates or members are made in two or more parts: for example a central wearing part of particularly noble material (high melting point ceramic, metallic ceramic, and so on) surrounded by a less noble and less expensive support material (alumina, magnesia, and so on).

In this case the technique of cylindrical distribution of wear makes it possible for the size of the central insert to be reduced to the minimum, depending on requirements dictated by the diameter of the hole, resistance to thermal shocks and resistance to physical and chemical attack by the fluid poured.

In closure systems at present in use for pouring steel, the fixed and movable plates are frequently surrounded by thick metal hooping, crimped under heat, which is intended to protect them against possible disintegration when they are dismantled.

This hooping may advantageously consist of a ring of ceramic material having adequate elasticity or a ring of shape-memorizing metal.

In the case of an insert, the refractory material surrounding the latter may serve both as support and as hooping, if an appropriate material is selected.

This hooping may be provided with a device avoiding any rotation of the movable plate relative to the slide during pivoting operations in the course of the pouring.

In a variant of the invention the central insert of the movable closure member is integral with the bottom collector nozzle.

The duly ground top surface of the combined insert and nozzle then constitutes the central wearing member of the movable closure means, being fastened to the latter by conical interlocking.

The conical joint is filled with an appropriate quick-setting adhesive or refractory slurry, which ensures the leaktightness and mechanical cohesion of the assembly.

After use the sliding assembly can be dismantled for the purpose of changing the combined insert and nozzle to allow further use.

In a variant of the invention the combined insert and nozzle is a "consumable" component, which means that, after dismantling, its top worn part is reground with the aid of a special machine, so as to enable it to be reassembled and used again.

The pressure by which the plates are applied one against the other must ensure leaktightness and the retention of sufficient flexibility of the assembly, and in particular must absorb the expansions of the refracttory components; it is exerted by the bottom fixed member of the system, generally called the "cover". This cover is for example reinforced by ribs or longitudinal members at the point where pressure is applied to the movable assembly.

In order to reduce friction, use may be made of balls to enable the slide to slide against the cover.

In a variant of the invention the balls are of ceramic material, which is also true of the bearing surfaces on which they circulate; they may even bear against the ground bottom face of the movable plate itself.

In another variant the balls are replaced by plain bearing surfaces of suitably treated metal or of ceramic material.

The collector nozzle fastened to the movable plate is connected to the latter by a refractory joint (slurry or dry refractory felt), the nozzle being held against the movable plate by its support.

For the purpose of applying pressure to clamp the cover on the assembly it is possible to make use of metallic or ceramic springs or small hydraulic or pneumatic rams, or to rely on the natural elongation of clamp screws or different judiciously designed mechanical parts, or else to employ any other means known to those versed in the art.

In view of the axial symmetry inherent to the present invention, it is possible to use the nozzle for clamping the plates against each other in the most important and most effective zone, namely the zone surrounding the hole.

It is in fact in that zone that the metal may start to infiltrate, and it is also in that zone that thermal stresses are the most severe.

In a variant of the invention, instead of exerting its pressure on the slide, the cover applies pressure to the nozzle, by way of its support.

In a variant of the invention use is made of a threaded nozzle support; the rotation of the support raises the nozzle and pushes the movable plate upwards, against the fixed plate, the reaction loads being absorbed by the cover.

The cover may also be tightened with the aid of a conventional torque wrench.

In a variant of the invention the clamping may be effortlessly effected with the aid of worms, racks or gears driving the sliding assembly; for this purpose it is sufficient to secure the nozzle support with the aid of a wedge fastened to the frame or the cover and to turn the slide in the appropriate sense, as if the movable plate were being adjusted in direction.

In the course of this operation the tightening torque of the motors or rams will be limited in order not to overtighten the plates.

After the tightening, the wedge will of course have to be removed.

In another variant of the invention the wedge is replaced by a torque-limiting locking device; in this way, when the tightening of the plates reaches a certain predetermined value the locking of the nozzle in respect of rotation is overridden and it is again free to turn together with the slide assembly.

The torque-limiting locking device can then be removed in order to save it from the thermal stresses during the pouring of metal.

Tightening in this way must be effected in the open position, when all the components are coaxial; the closed position can then be assumed.

This process also assumes the use of a movable joint between the collector nozzle and the plate, withstanding the relative sliding of the two parts during the tightening operation (for example ceramic felt).

The plate movable inside the slide must retain a little vertical displaceability, parallel to itself, in order to permit clamping by means of the nozzle, but it must not be able to turn, in order to avoid possible untightening during use.

In a variant of the invention the plate is left free to turn in its seat at the same time as the nozzle, in order to prevent any sliding at the joint; in this case it is also possible to use a combined insert and nozzle, as described further on. The whole arrangement is then locked against any further rotation during use.

In view of the short closing travel, the cantilevering created by the eccentricity of the nozzle in the closed position will not compromise the leaktightness of the assembly, since the two plates remain in contact over the greater part of their surface.

In a variant of the invention this type of clamping is adapted to the case of a device comprising three plates. Since in fact the collector nozzle remains stationary in the axis of the fixed plate, the clamping forces are not displaced.

In this case conventional tightening of the nozzle with the aid of a torque wrench appears more suitable.

In another variant the movable plate and the collector nozzle are preassembled or integrally cast, and form a one-piece unit.

In another variant of the invention the collector nozzle is positioned in the conventional manner by inserting it through the interior of the slide before the movable plate is placed in position; this arrangement does not permit the inependent fitting and removal of the nozzle.

The consequences of the axial symmetry and the rational utilization of closure means are numerous;

the elimination or substantial reduction of cracking phenomena in the case of the refractory components, so that it is possible to use new refractories sensitive to thermal shocks.

harmonious wear of the fluid passage apertures, thus reducing dynamic flow disturbances.

reduction of the dimensions of the closure means in relation to the flow diameter.

reduction of the amplitude of the travel necessary for the closure member.

elimination or reduction of soiling and unidirectional depositions in the runner because of the pivoting of the member or plate; the pivoting characteristics of the sliding plate can be optimized so as very particularly to combat depositions (rotations of a°+180° in opposite directions, for example).

Furthermore, the elimination of tensions because of the homogeneous transmission of the thermal wave makes it possible for the refractory members or plates to be ground on both faces and to be re-used after being turned over, so that their bottom face becomes the top face and vice versa, without entailing the cracks usually found with plate configurations known at the present time.

In this way, the pouring apertures then offer practically new leading edges.

Taking into account the fact that the centre of the heat flow must as far as possible be equidistant from the periphery of the plates, it appears that it is advantageous to pour with full stream, so as to avoid excessive off-centering and rupture of the flow of metal, which in addition entail the usual disadvantages: disruption of the stream at the outlet of the closure means, excessive turbulence, cavitation phenomena, intake of gas from outside, and so on.

In order to do this it is desirable, whenever possible, to optimize the initial diameter of the plates in dependence on the desired flow.

Nevertheless, through its very principle, this type of closure means is of the "short travel" type, and off-centering is reduced to the strict minimum.

BRIEF DESCRIPTION OF THE DRAWINGS

The invention is illustrated in the accompanying drawings, in which.

Figure 1:
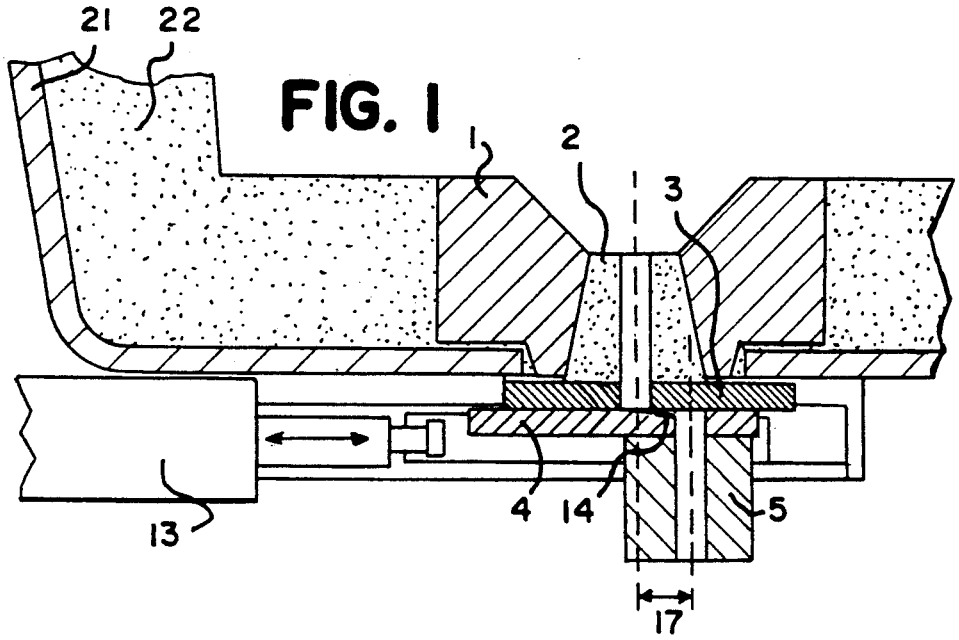
FIG. 1 shows in section a conventional device installed on a steel pouring ladle, of which part is shown with its steel wall 21, its protective refractory lining 22 in which the seating block 1 is built in, and the inner nozzle 2. The following are also shown.

the fixed plate 3, the movable sliding plate 4, the outer collector nozzle 5, and the tongue 14 corresponding to erosion due to the passage of the molten metal when the sliding plate 4 is shifted relative to the fixed plate 3.

the hydraulic ram 13 which brings about the opening, closing or adjustment movements of the device.

17 indicates the maximum offset possible between the apertures, or the "travel" of the system.

Figure 2:
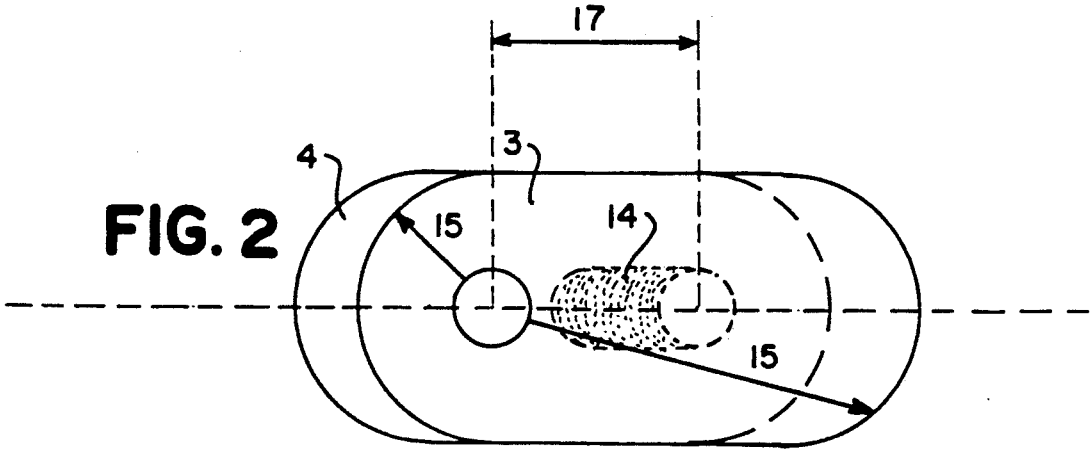

FIG. 2 is a view from above of the fixed top plate 3 of a conventional device and also, partly hidden, the sliding bottom plate 4 in the closed position, with the wear tongue 14. Two different paths 15 for the heat wave, starting from the molten metal passage aperture and leading to the periphery of the plate, are also shown.

Figure 3:
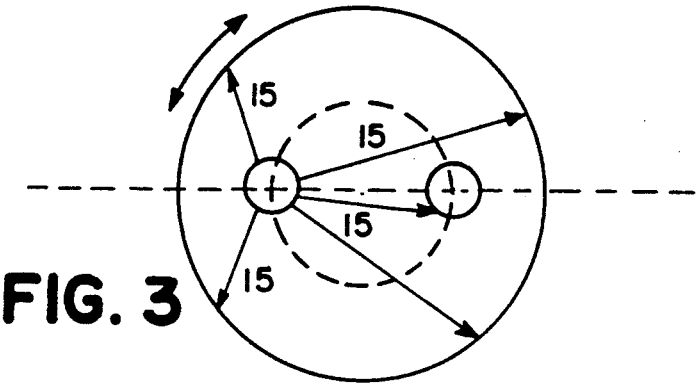

FIG. 3 shows a plate of a conventional rotary device having two holes, together with the different paths 15 of the heat wave.

Figure 4:
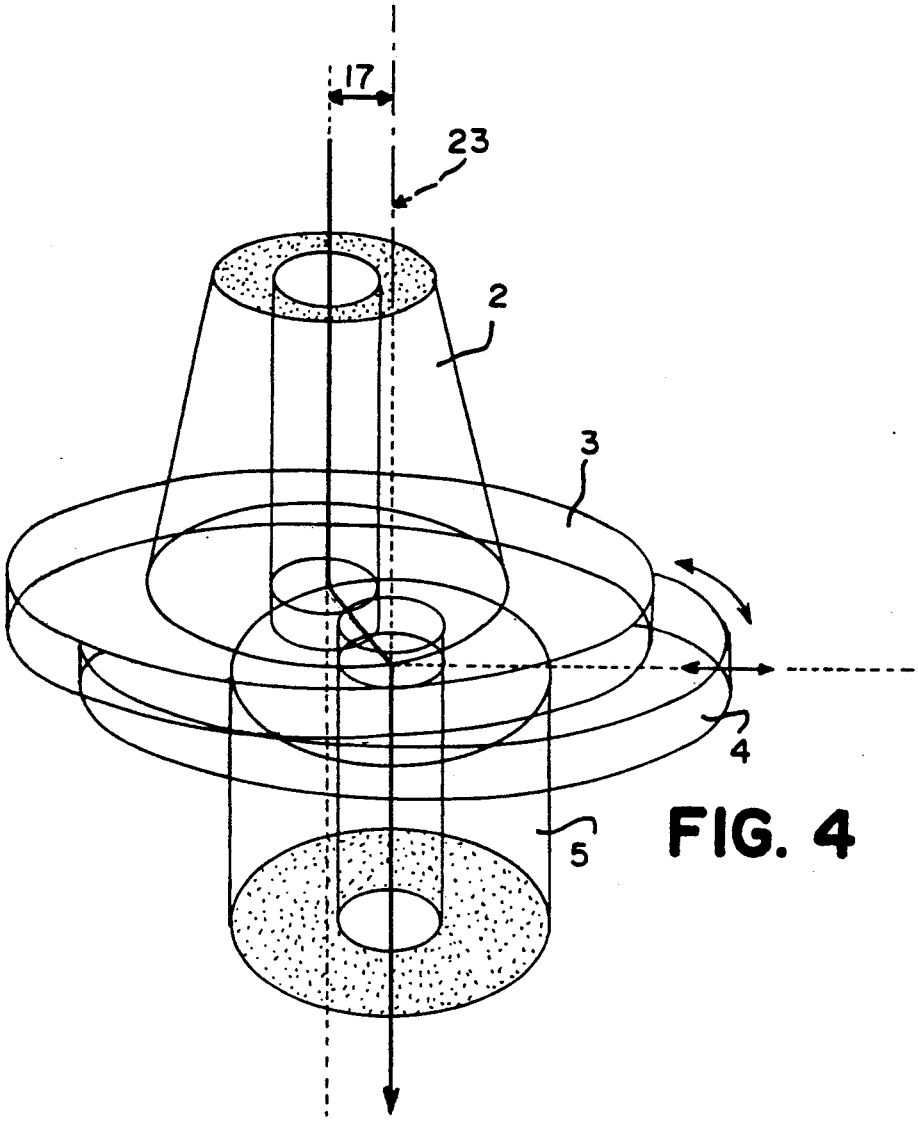

FIG. 4 shows a diagram illustrating the principle of the device according to the invention, with a fixed plate 3 and a sliding plate 4, the plates being round and having a central aperture. The sliding plate 4 is also adapted to turn about its axis 23.

Figure 5A:
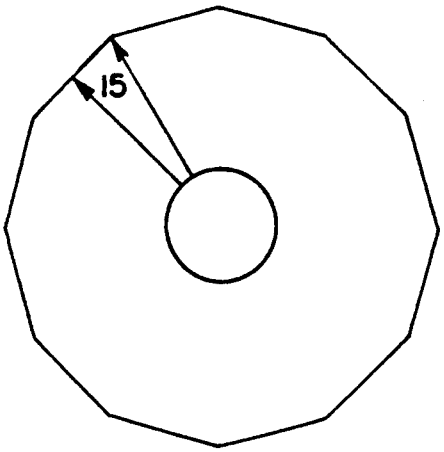
Figure 5B:
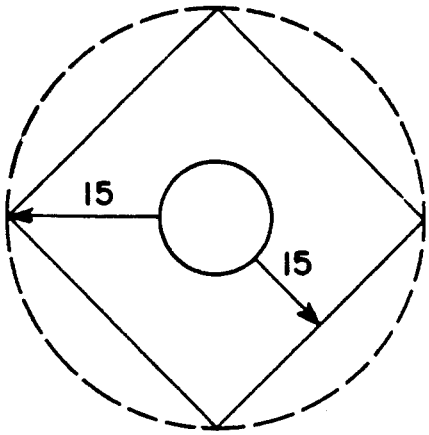

FIG. 5 shows two extreme cases of polygons which are axially symmetrical in relation to the axis of the hole; in the case of the square it can be seen that the differences between the paths 15 of the heat wave are very marked in comparison with the nonagon.

Figure 6:
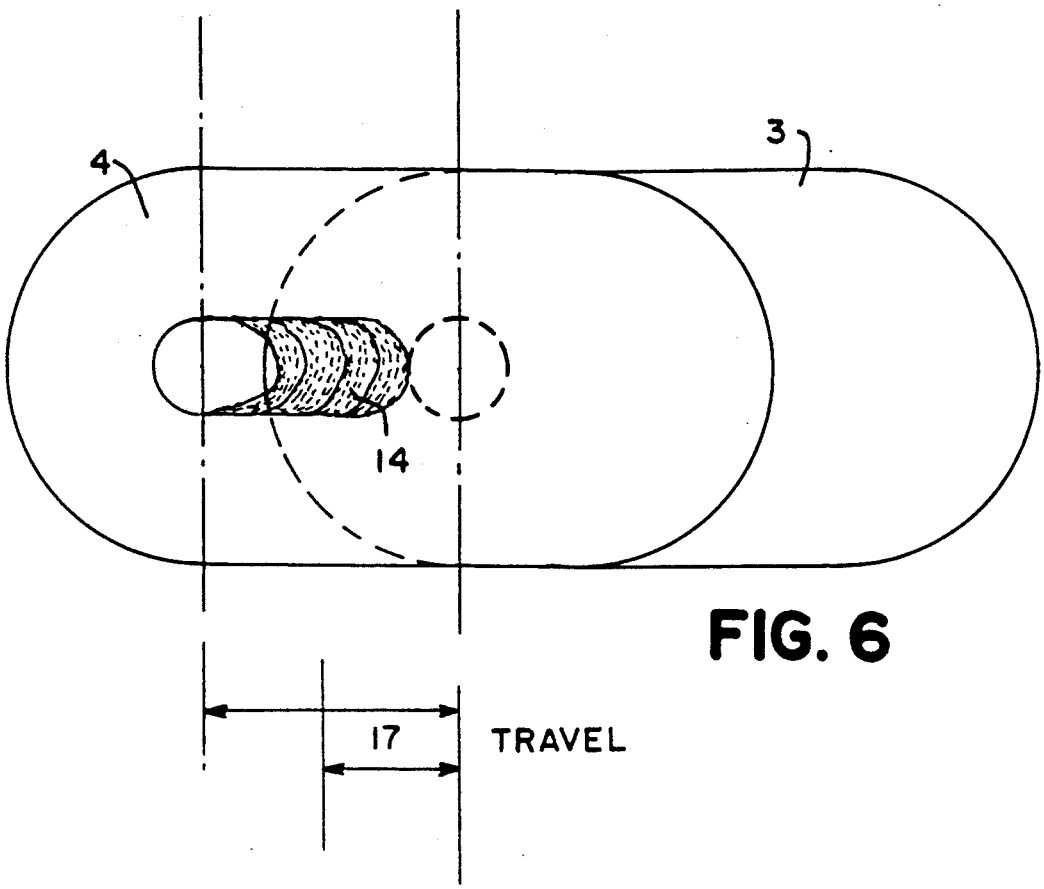
Figure 7:
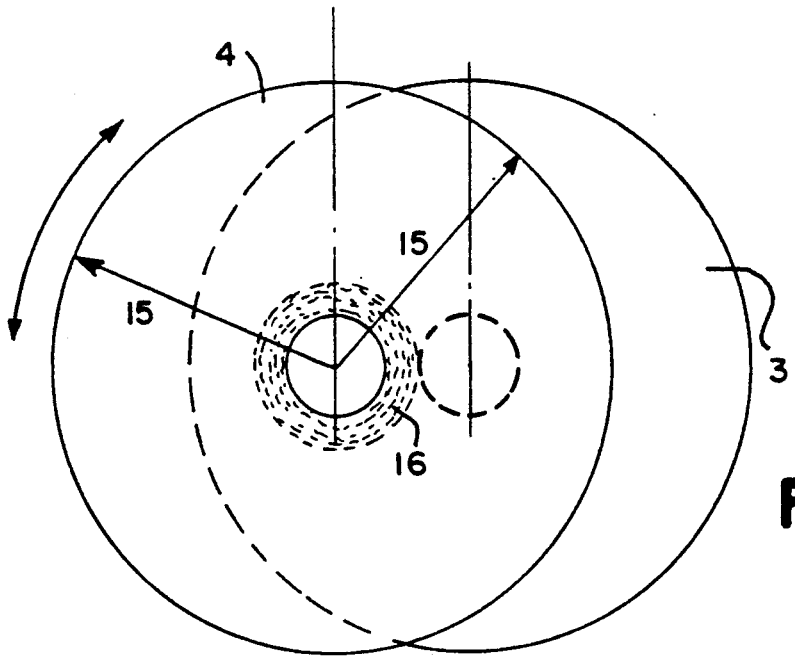

FIGS. 6 and 7 show the plates of a conventional device (FIG. 6) and those of a device according to invention (FIG. 7), viewed from below. It is possible to see the difference between the tongue-shaped wear in the conventional linear system (FIG. 6) and the symmetrical wear 16, distributed over the periphery of the hole, in the system according to the invention (FIG. 7), where the sliding plate 4 can turn about its axis. The reduction of the travel 17 achieved with the conventional device (FIG. 6) in comparison with that achieved with the device according to the invention (FIG. 7) is also shown.

Figure 8:
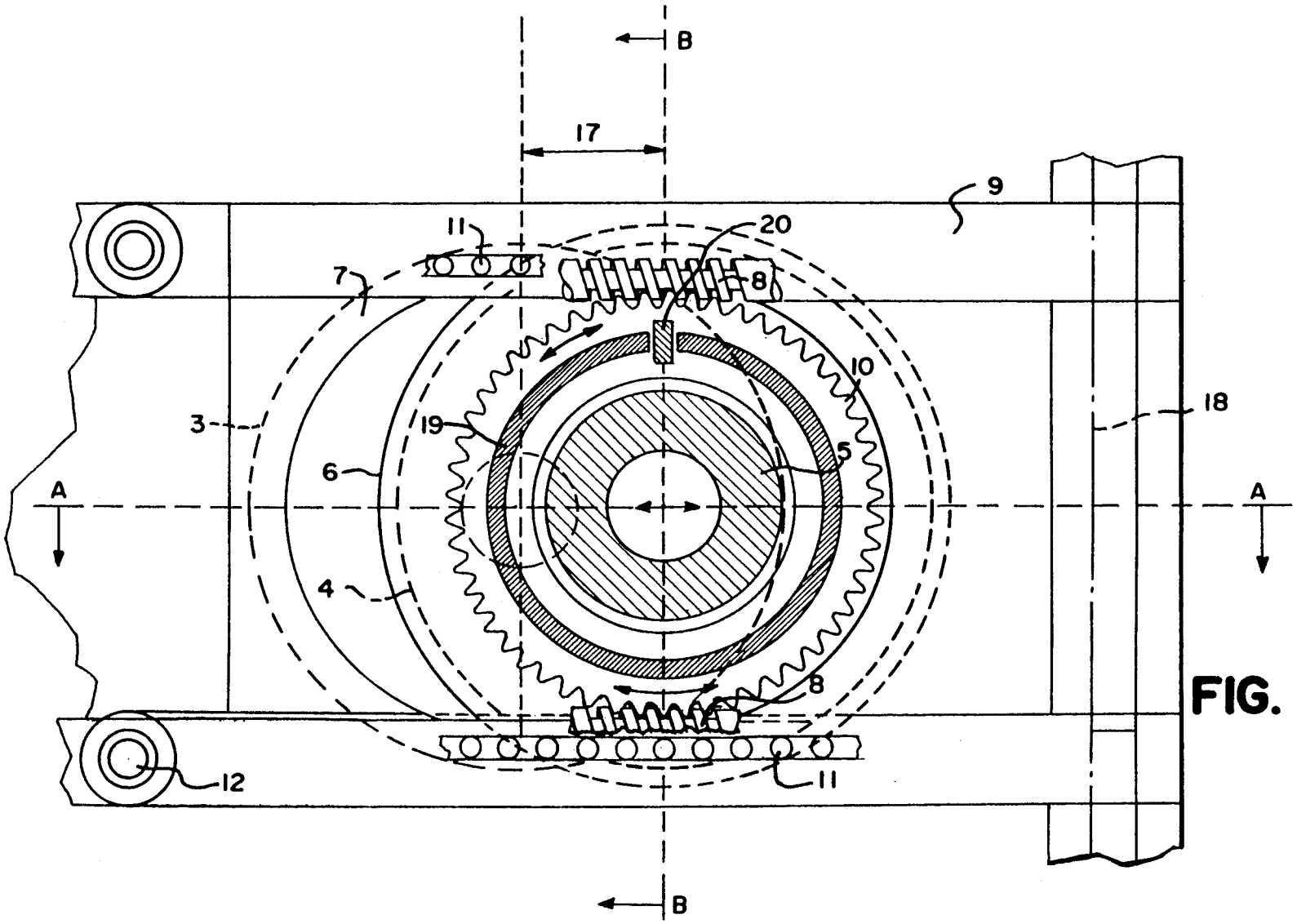

FIG. 8 shows an embodiment of the invention, viewed from below.

Figure 9:
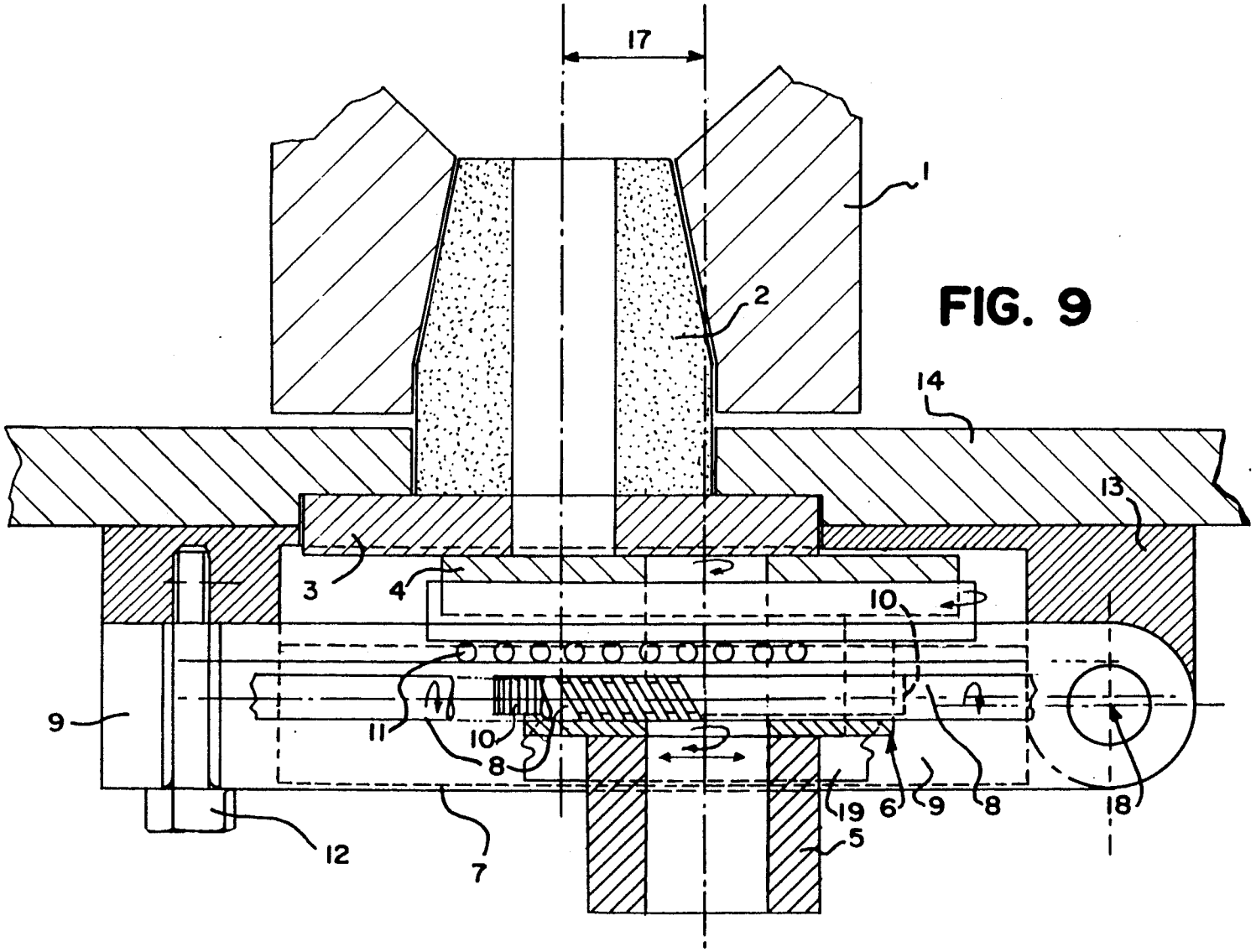

FIG. 9 shows a section on the line A-A of the embodiment of the invention shown in FIG. 8.

Figure 10:
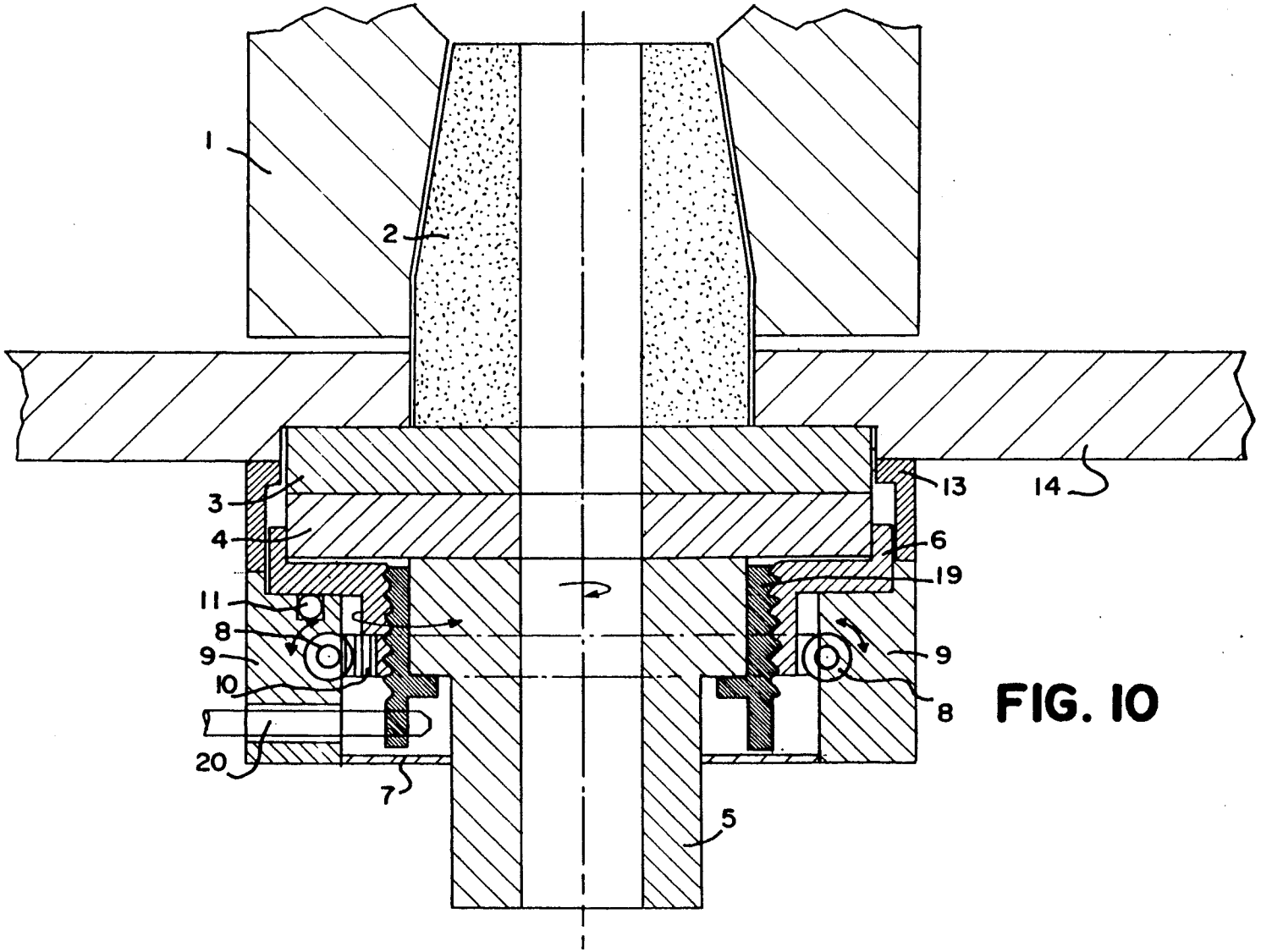

FIG. 10 shows a section on the line B-B of the embodiment shown in FIG. 8.

FIG. 11 shows diagrammatically a conventional form of construction of a sliding closure means comprising three plates. 3 designates the two fixed plates which enclose between them the movable plate 3. The main advantage of this type of system is that the collector nozzle 5 remains fixed instead of moving with the movable plate.

FIG. 12 shows an embodiment of the invention, in which use is made of a combined insert and nozzle 4–5.

According to an example of configuration shown in FIGS. 8, 9 and 10, and intended for a ladle for pouring steel, the device comprises in a conventional arrangement with two plates, from top to bottom:

the seating block 1 (consisting of one or more parts) built into the ladle lining by the usual methods.

the inner nozzle 2 (consisting of one or more parts) built into the seating brick with the aid of an appropriate mortar or slurry.

the closure frame 13, a very strong machined metal part supporting all the components and ensuring the constant geometry of the whole arrangement; it is strongly fixed to ladle bottom plate 14.

the round fixed plate 3 fastened in the frame with the aid of a jaw type or other device preventing any localized mechanical stress; small studs may be provided to prevent accidental rotation.

the sliding, pivoting plate 4 fixed in the pivoting slide 20 (sic) by a device similar to that used for the fixed plate.

the pivoting slide 6 provided with an external toothing 10 intended both for effecting the linear movement and for the rotation of the movable plate 4.

the collector nozzle support 19, which when screwed into the slide 6 brings about the compression of the joint between the nozzle 5 and the plate 4 and the clamping of the plates 3 and 4 one against the other.

the cover 7 reinforced by two longitudinal members 9, and pivoting on the pivot axis 18, is locked to the frame 13 by two screws 12.

two worms 8 or two racks meshing with the external toothing on the slide; these worms act in the following manner:

a) The turning of a single one of these worms brings about the rotation and translation of the slide, as if it "rolled" on the fixed worm.

b) The simultaneous rotation of both worms may result in the pure translation, pure rotation or rotation and translation of the slide, depending on their directions and speeds of rotation.

The worms may for example be driven by two electric motors, controlled and regulated independently.

The same results can be obtained with two racks, driven for example by two hydraulic rams.

Other possibilities exist, based on the same principle and utilizing techniques known to those versed in the art.

two rigid longitudinal members 9, forming an integral part of the cover 7 compress the slide, during translation and rotation, against the fixed plate 3 with the aid of balls 11 intended to facilitate the movements of the slide; these balls circulate in grooves provided for the purpose in the longitudinal members.

Adequate cooling is provided to ensure correct operation of the whole arrangement.

Many other variants meeting the multiple requirements of the industry spring from the concept of axial symmetry of revolution of the closure means forming the oject of the present invention.

I claim:

1. A slide valve closure device for a discharge opening in a container for corrosive liquids, comprising wear resistant, planar closure components, and means for sliding a first closure component provided with a first aperture relative to a second, contiguous closure component provided with a second aperture so that at least partial coincidence of the first aperture and the second aperture establishes a flow, and non-coincidence of the first aperture and the second aperture ensures a leak-tight closure of the container;

wherein at least the first aperture of the first closure component has a central axis of rotation and a single, central axial aperture positioned so that the difference between longest paths of heat transfer and shortest paths of heat transfer originating from the central axial aperture correspond to regular homogenous expansion of the first closure component;

wherein at least the first aperture of the first closure component is positioned coaxially relative to the central axis of the first closure component;

wherein the first closure component is displaceable relative to the second closure component along either a rectilinear path or a curvilinear path passing through the central axis of the first closure component to cause coincidence and non-coincidence of the central axis aperture with the second aperture provided in the second closure component contiguous with the first closure component; and wherein the first closure component is rotatable about its central axis to provide symmetrical wear distributed over the periphery of the central axial aperture.

2. The closure device of claim 1 wherein the first closure component is formed of a refractory material.

3. The closure device of claim 1 wherein the first closure component is substantially circular in shape.

4. The closure device of claim 1 wherein the first closure component is substantially oval in shape.

5. The closure device of claim 1 wherein the first closure component is substantially polygonal in shape.

6. The closure device of claim 1 wherein the first closure component is displaceable along a rectilinear path.

7. The closure device of claim 1 wherein the first closure component is displaceable along a curvilinear path.

8. The closure device of claim 1 wherein the first closure component is simultaneously displaceable and rotatable about the central axis.

9. The closure device of claim 1 wherein the first closure component is displaceable in two opposite directions relative to the aperture of the second closure component.

10. The closure device of claim 1 wherein a single means is employed for displacement and rotation of the first closure component.

11. The closure device of claim 10 wherein the first closure component includes a support having teeth for coacting with a drive unit.

12. The closure device of claim 1 wherein the first closure component is comprised of at least two parts.

13. The closure device of claim 12 wherein the first closure component includes a central insert covering wearing zone portions of the first closure component.

14. The closure device of claim 13 wherein the central insert includes an integral bottom collector nozzle, and is fitted into the first closure component.

15. The closure device of claim 14 wherein the combined insert and nozzle fit into the first closure component by conical interlocking means having a defined clearance and angle.

16. The closure device of claim 15 wherein the interlocking means is coated with a material which compensates for dimensional tolerances.

17. The closure device of claim 14 wherein the combined insert and nozzle are dismantleable, for re-grinding of top face portions for further use.

18. The closure device of claim 14 wherein the first closure component is clamped in position by means of the collector nozzle.

19. The closure device of claim 18 wherein the first closure component is clamped in position by the combined insert and nozzle.

20. The closure device of claim 18 wherein the first closure component is free to turn in its support during clamping.

21. The closure device of claim 18 wherein the first closure component and the nozzle form an integral unit.

22. The closure device of claim 14 wherein the sliding means clamps support portions of the nozzle, in combination with a wedge.

23. The closure device of claim 22 wherein the sliding means clamps support portions of the nozzle, in combination with means for limiting tightening torque of the sliding means.

24. The closure device of claim 1 wherein the first closure component is supported by balls of material.

25. The closure device of claim 22 wherein the first closure component is supported on plain bearing surfaces.

26. The closure device of claim 1 wherein the first closure component is clamped in position by springs of ceramic material.

27. The closure device of claim 1 wherein three closure components are provided, including two fixed plates enclosing a movable plate.

* * * * *